US006497630B1

(12) United States Patent
Hebert et al.

(10) Patent No.: US 6,497,630 B1
(45) Date of Patent: Dec. 24, 2002

(54) WOUND GOLF BALL

(75) Inventors: Edmund A. Hebert, Fairhaven, MA (US); Jeffrey L. Dalton, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/497,205

(22) Filed: Feb. 3, 2000

(51) Int. Cl.[7] ..... A63B 37/06
(52) U.S. Cl. ..... 473/357; 473/356; 473/362
(58) Field of Search ..... 473/351, 354, 473/356, 357, 361, 362, 371, 370, 374, 376, 377

(56) References Cited

U.S. PATENT DOCUMENTS

| | | | | |
|---|---|---|---|---|
| 4,783,078 A | * | 11/1988 | Brown et al. | 473/362 |
| 4,938,471 A | * | 7/1990 | Nomura et al. | 473/357 |
| 5,194,191 A | * | 3/1993 | Nomura et al. | 264/25 |
| 5,397,129 A | | 3/1995 | Kato et al. | |
| 5,445,387 A | | 8/1995 | Maruko et al. | |
| 5,704,852 A | | 1/1998 | Kato et al. | |
| 5,704,853 A | | 1/1998 | Maruko et al. | |
| 5,752,888 A | | 5/1998 | Maruko et al. | |
| 5,762,568 A | | 6/1998 | Kato | |
| 5,766,096 A | | 6/1998 | Maruko et al. | |
| 5,792,009 A | | 8/1998 | Maruko | |
| 5,800,286 A | | 9/1998 | Kakiuchi et al. | |
| 5,810,677 A | | 9/1998 | Maruko et al. | |
| 5,816,939 A | * | 10/1998 | Hamada et al. | 473/357 |
| 5,816,942 A | | 10/1998 | Hayashi et al. | |
| 5,823,888 A | | 10/1998 | Maruko et al. | |
| 5,827,167 A | | 10/1998 | Dougan et al. | |
| 5,848,942 A | | 12/1998 | Kato | |
| 5,853,337 A | | 12/1998 | Moriyama et al. | |
| 5,888,151 A | | 3/1999 | Hayashi | |
| 6,113,505 A | * | 9/2000 | Boehm | 473/357 |
| 6,290,610 B1 | * | 9/2001 | Reid, Jr. et al. | 473/357 |

FOREIGN PATENT DOCUMENTS

GB 2311733 A 10/1997

OTHER PUBLICATIONS

Callister, Jr., William D., Materials Science and Engineering: An Introduction, 4th Edition. New York: John Wiley & Sons, Inc., copyright 1997, p. 785.*

* cited by examiner

*Primary Examiner*—Stephen Blau
*Assistant Examiner*—Alvin A. Hunter
(74) *Attorney, Agent, or Firm*—Swidler Berlin Shereff Friedman, LLP

(57) ABSTRACT

A wound golf ball comprising a center, a cover, and at least one wound layer disposed between the center and the cover, wherein the at least one wound layer is formed of a tensioned elastomeric thread having at least one ply, wound about the center with a tension of less than about 700 g, and wherein the center has a first deformation value, formed by applying a load to the center within the range from an initial load of 10 kg to a final load of 130 kg, and the golf ball has a second deformation value, formed by applying a load to the golf ball within the range from an initial load of 10 kg to a final load of 130 kg, such that a difference between the second deformation and the first deformation is less than 0.4 mm.

48 Claims, 2 Drawing Sheets

WOUND GOLF BALL

FIELD OF THE INVENTION

This invention relates generally to golf balls, and more particularly to wound golf balls, having an improved center covered with elastomeric thread wound using a novel winding tension.

BACKGROUND OF THE INVENTION

Golf balls can be divided into several general categories, such as solid golf balls having one or more layers and wound golf balls. Solid golf balls include both one-piece and two-piece balls. One-piece golf balls are easy to construct and relatively inexpensive, but are considered by most to have poor playing characteristics. These golf balls are generally limited for use as range balls. Two-piece balls are typically constructed with a solid polymeric core encased with a cover and are generally the most popular with recreational golfers because they are very durable and provide maximum distance. Typically, the core is formed from polybutadiene that is chemically crosslinked with zinc diacrylate and/or other similar crosslinking agents. Two-piece balls are generally easy to manufacture, but are regarded as having limited playing characteristics. Solid golf balls also include multi-layer golf balls that are comprised of a solid core of one or more layers and/or a cover of one or more layers. These balls are regarded as having an extended range of playing characteristics.

Wound golf balls are the preferred ball of more advanced players due to their high spin and soft "feel" characteristics. Wound golf balls typically include a solid, hollow, or fluid-filled center surrounded by a tensioned elastomeric material and a cover, the combination of which results in a wound core. The wound core is then covered with a durable cover material, such as a Surlyn®, or a softer "performance" cover, such as balata or polyurethane.

Wound golf balls are generally softer in "feel" and provide more spin than solid golf balls, which enables a skilled golfer to have more control over ball flight. This control is especially important for approach shots into the green, where the high spin rate of soft-covered, wound golf balls enables the golfer to stop the ball very near its landing position. The higher spin rate that aids in ball control on approach shots and around the green also causes wound golf balls to sacrifice some distance compared to hard-covered, solid golf balls. However, the advantages of wound constructions over solid ones are more related to targeting and accuracy than they are to distance.

To meet the needs of golfers having various levels of skill, golf ball manufacturers are also concerned with adjusting the compression of the ball. Compression is a measurement of the deformation or deflection of a golf ball under a fixed load. A golf ball with a higher compression feels harder than a golf ball having a lower compression. Wound golf balls generally have a lower compression that is preferred by better players, to whom "feel" and control are more important than distance. Whether wound or solid, all golf balls become more resilient (i.e., have higher initial velocities) as compression increases. Manufacturers of both wound- and solid-construction golf balls must, therefore, balance the requirement of higher initial velocity afforded from higher compression with the desire for a softer "feel" gained by lower compression.

It is well-known in the art that to make wound golf balls, manufacturers typically use automated winding machines to stretch the threads to various degrees of elongation during the winding process, with every effort made to avoid subjecting the threads to unnecessary incidents of breakage. As the elongation and the winding tension increase, the compression and initial velocity of the ball will increase accordingly. This increase in compression and velocity result in increased distance when the wound ball is hit with a club.

There are some drawbacks to the conventional threads used in golf balls. The thread occasionally contains weak points that can break during winding or during play. When a thread breaks during manufacturing, the winding machine either needs to be restarted or, in many cases, an operator must manually re-thread the machine prior to restarting. Both of these situations decrease productivity and are obviously undesirable. The thread can also break during play due to impact of a club with the ball resulting in, for example, a loss of compression and/or initial velocity. Additionally, for a fluid-filled wound ball, a broken thread can cut through the envelope containing the fluid, destroying the structural integrity of the ball, making it virtually unplayable.

To date, golf ball manufacturers have typically combined high-tension windings with very soft centers, the theory being that the tensioned windings provide the "engine" for the golf ball and the soft center provides the desired "feel" characteristics. As one of ordinary skill in the art knows, winding tensions are typically greater than 700 g and can be as high as 1000 g or more. Manufacturers are generally careful to limit solid center diameter to allow a sufficient amount of wound material to provide the desired resilience in the golf ball.

It would be advantageous to manufacture a wound golf ball in which the tensioned thread was wound at a lower tension to decrease thread breakage, while still retaining desirable compression, velocity, distance, and spin characteristics afforded by a harder center. A combination previously thought to be unacceptable. The present invention discloses such an advantageous golf ball.

SUMMARY OF THE INVENTION

The present invention is directed towards a wound golf ball comprising a center, a cover, and at least one wound layer disposed between the center and the cover; wherein the at least one wound layer is formed of a tensioned elastomeric thread having at least one ply, wound about the center with a tension of less than about 700 g; and wherein the center has a first deformation value, formed by applying a load to the center within the range from an initial load of 10 kg to a final load of 130 kg, and the golf ball has a second deformation value, formed by applying a load to the golf ball within the range from an initial load of 10 kg to a final load of 130 kg, such that a difference between the second deformation and the first deformation is less than 0.4 mm.

In one embodiment, the deformation difference is no greater than about 0.3 mm. In another embodiment, the tension is less than about 500 g and is preferably between about 400 g and 500 g. In still another embodiment, the first deformation value, formed by applying a load to the center within the range from an initial load of 10 kg to a final load of 130 kg, is less than 3.5 mm. Preferably, the first deformation value, formed by applying a load to the center within the range from an initial load of 10 kg to a final load of 130 kg, is no greater than about 3.1 mm.

In a preferred embodiment, the cover is a single layer. In another embodiment the cover is formed of two or more layers.

In another embodiment, the tensioned elastomeric thread comprises two or more plies. Preferably, the tensioned elastomeric thread comprises cis-polyisoprene and more preferably, a blend of cis-polyisoprene and natural rubber. In one embodiment, the tensioned elastomeric thread has a thickness of between about 0.01 and 0.06 in. In a preferred embodiment, the thickness is between about 0.018 and 0.03 in. The tensioned elastomeric thread preferably has a width of between about 0.04 and 0.08 in, and more preferably, between about 0.06 and 0.07 in.

Preferably, the center comprises polybutadiene. In one embodiment, the center further comprises a metal salt diacrylate, a free radical initiator, and a filler. In another embodiment, the center has a center diameter of greater than about 1.3 in, and more preferably between about 1.3 and 1.4 in. In a preferred embodiment, the center diameter is between about 1.35 and 1.4 in. In one embodiment, the center has a hardness of between about 60 and 90 Shore D. In another embodiment, the center has a hardness of between about 70 and 80 Shore D.

In another embodiment, the cover has a thickness from about 0.03 in to about 0.12 in and preferably about 0.04 to 0.09 in. In a preferred embodiment, the cover has a thickness of about 0.05 to 0.085 in. In still another embodiment, the cover has a Shore D hardness of greater than about 60. Preferably, the cover has a Shore D hardness of between about 63 and 73 Shore D. In one embodiment, the cover comprises a blend of about 40 to 60 weight percent of a sodium ionomer and about 60 to 40 weight percent of a zinc ionomer.

In yet another embodiment, the golf ball has an outer diameter of greater than about 1.68 in. Preferably, the center and the at least one wound layer form a core having an outer diameter of between about 1.51 and 1.62 in. In a further embodiment, the outer diameter is between about 1.55 and 1.58 in.

The present invention is also directed to a wound golf ball comprising a center, a cover, and at least one wound layer disposed between the center and the cover; and wherein the at least one wound layer is formed of a tensioned elastomeric thread of at least one ply having an elongation of less than about 800 percent.

In one embodiment, the center has a first deformation value, formed by applying a load to the center within the range from an initial load of 10 kg to a final load of 130 kg, and the golf ball has a second deformation value, formed by applying a load to the golf ball within the range from an initial load of 10 kg to a final load of 130 kg, such that a difference between the second deformation and the first deformation is less than 0.4 mm. Preferably, the deformation difference is no greater than about 0.3 mm. In a preferred embodiment, the elongation is between about 500 and 800 percent.

In another embodiment, the first deformation value, formed by applying a load to the center within the range from an initial load of 10 kg to a final load of 130 kg, is less than 3.5 mm. Preferably, the first deformation value, formed by applying a load to the center within the range from an initial load of 10 kg to a final load of 130 kg, is no greater than about 3.1 mm.

In another embodiment, the tensioned elastomeric thread has a thickness of between about 0.01 and 0.06 in. Preferably, the thickness is between about 0.018 and 0.03 in. In still another embodiment, the tensioned elastomeric thread has a width of between about 0.04 and 0.08 in. Preferably, the width is between about 0.06 and 0.07 in.

In yet another embodiment, the center has a center diameter of greater than about 1.3 in. More preferably, the center diameter is between about 1.3 and 1.4 in. Most preferably, the center diameter is between about 1.35 and 1.4 in. In a further embodiment, the center has a hardness of between about 60 and 90 Shore D. Preferably, the center has a hardness of between about 70 and 80 Shore D.

In one embodiment, the cover has a Shore D hardness of greater than about 60. Preferably, the cover has a Shore D hardness of between about 63 and 73 Shore D. In another embodiment, the center and the at least one wound layer form a core having an outer diameter of between about 1.51 and 1.62 in. In sill another embodiment, the outer diameter is between about 1.55 and 1.58 in.

DEFINITIONS

As used herein, the term "Atti compression" is defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball or its components. When the Atti Gauge is used to measure cores having a diameter of less than 1.680 inches, it should be understood that a metallic or other suitable shim is used to make the measured object 1.680 inches in diameter. However, when referring to the compression of a core, it is preferred to use a compressive load measurement. The term "compressive load" is defined as the normalized load in pounds for a 10.8-percent diametrical deflection for a spherical object having a diameter of 1.58 inches.

The term "fluid," as used herein, includes gases, pastes, liquids, gels, or any combination thereof.

As used herein, the term "fillers" includes any compound or composition that can be used to vary the density and other properties of the subject golf ball core.

The term "about," as used herein, should be understood to refer to both numbers in a range of numbers.

DETAILED DESCRIPTION OF THE PREFERRED EMBODIMENTS

Figure 1:
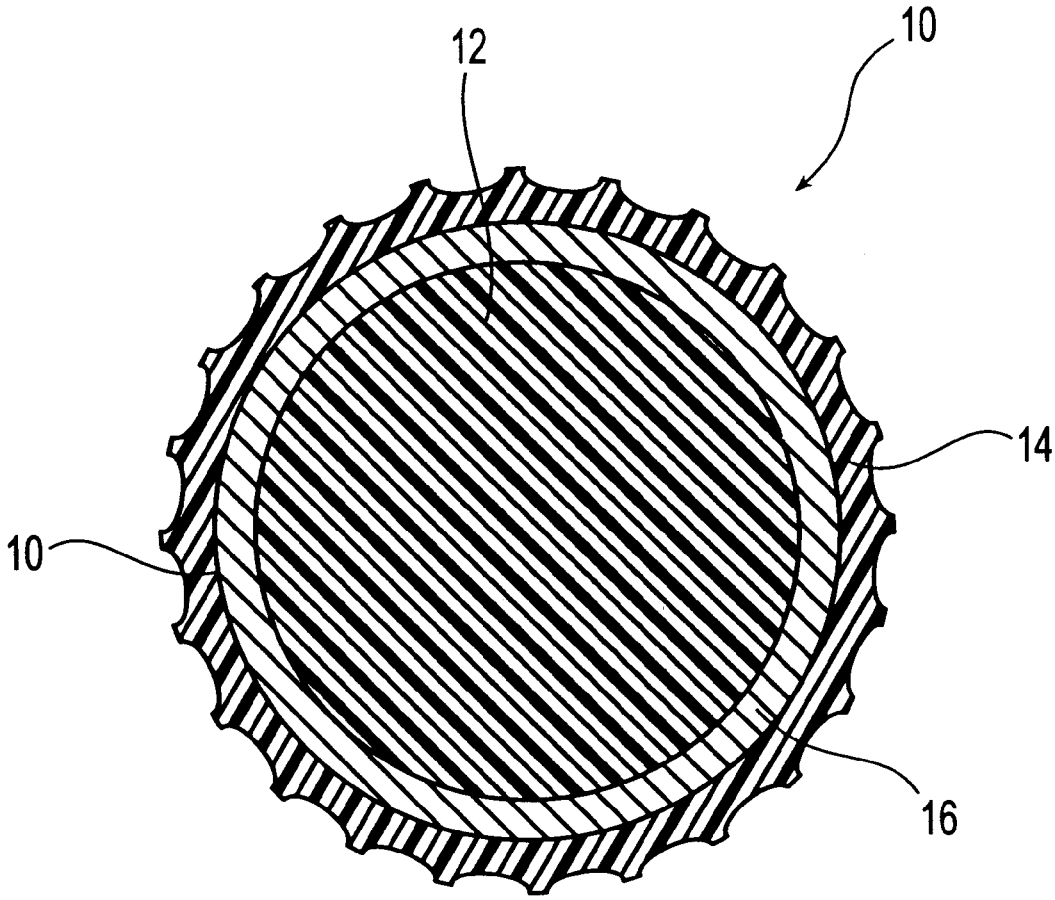
FIG. 1 is one embodiment of the wound golf ball of the present invention.

Referring to FIG. 1, a wound golf ball 10 of the present invention comprises a center 12 having at least one layer, a cover 14, and at least one wound layer 16 disposed between the center and the cover. The combination of the center 12 and the at least one wound layer 16 form the core 18 of the golf ball. The cover 14 is shown as a single layer. However, the cover can have more than one layer, such as in a two-layer cover construction, where the first layer surrounds the core and the second layer surrounds the first layer. Preferably, the cover is a single layer.

The wound layer 16 disposed about the center 12 comprises a tensioned elastomeric thread. The tension used in winding the thread material of the wound layer may be selected as desired to provide beneficial playing characteristics to the final golf ball.

Many different kinds of threads may be used for the wound layer of the present invention. The thread may be single-ply or may comprise two or more plies. Preferably, the thread of the present invention is single-ply. The thread may be selected to have different material properties, dimensions, cross-sectional shapes, and methods of manufacturing. If two or more threads are used, they may be identical in material and mechanical properties or they may be substantially different from each other, either in cross-section shape or size, composition, elongated state, and mechanical or thermal properties. Mechanical properties that may be varied include resiliency, elastic modulus, and density. Thermal properties that may be varied include melt temperature, glass transition temperature and thermal expansion coefficient. For example, the thread may be formed from fiber, including glass, carbon, or polymeric material, such as Hytrel®, a polyetherester commercially available from E. I. DuPont de Nemours of Wilmington, Del. Preferred threads are elastomeric, while graphite thread tends to be less preferred than other available thread types due to the difficulty in placing such threads under tension when being wound about a center. The most preferred thread material is cis-polyisoprene rubber, preferably at least about 60% of a blend of two synthetic cis-1,4 polyisoprene rubbers, and about less than 40% of a natural rubber. It is preferred that the synthetic cis-1,4 polyisoprene rubbers have a cis-1,4 content of at least 90%, however the cis-1,4 contents may vary for each rubber.

Threads used in the present invention may be formed using a variety of processes including conventional calendering and slitting, melt spinning, wet spinning, dry spinning and polymerization spinning. Any process known to those of ordinary skill in the art may be employed to produce thread materials for use in the wound layer. The winding tension and elongation may be kept the same or may be varied throughout the layer. Preferably, the winding occurs at a consistent level of tension so that the wound layer has consistent tension throughout the layer.

In addition, the winding patterns used for the wound layer can be varied as known by those of ordinary skill in the art. Although one or more threads may be combined to begin forming the wound layer, it is preferred to use only a single continuous thread.

Figure 2:
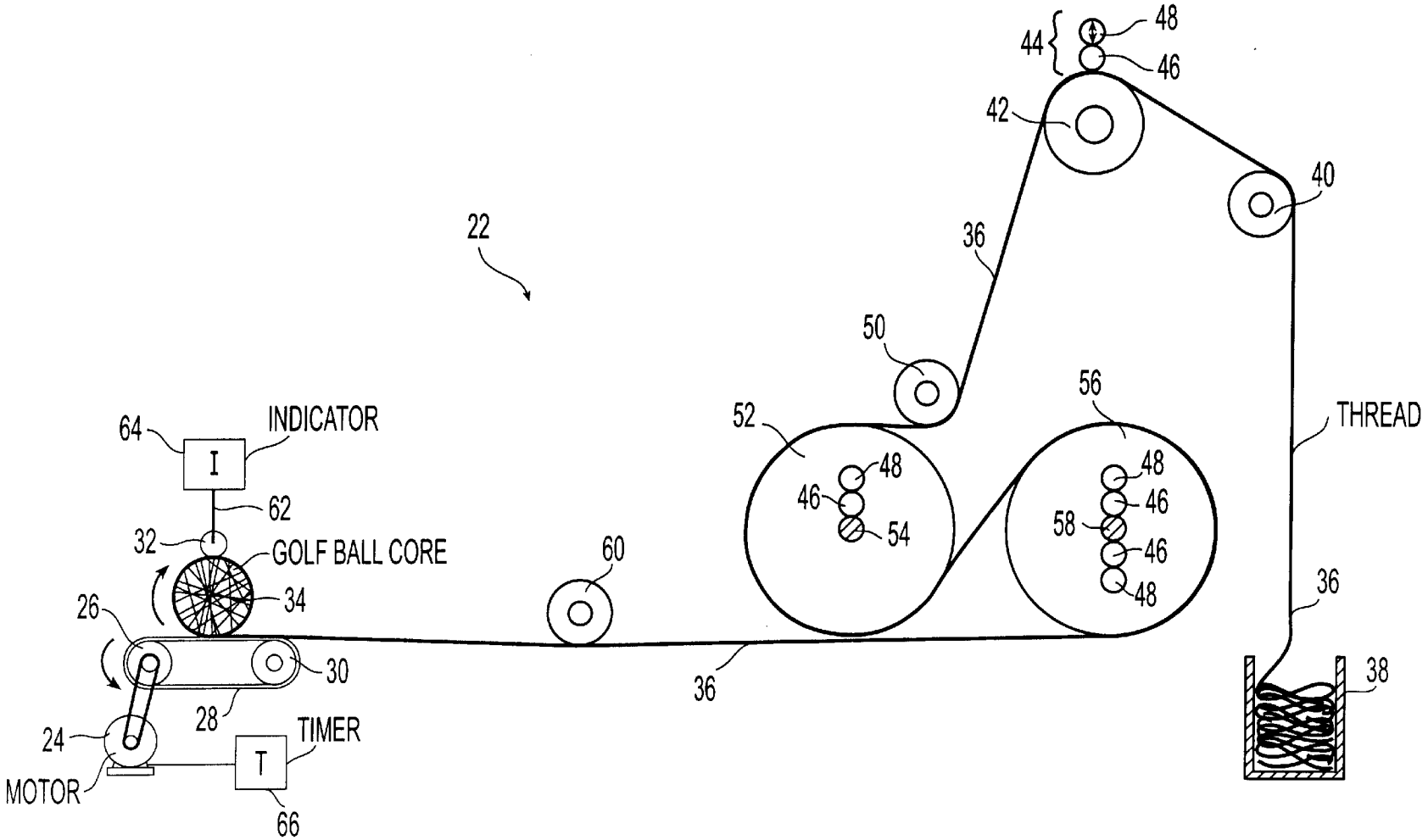
FIG. 2 is a winding machine that could be used to construct the wound layer of the present invention.

Turning now to FIG. 2, there is shown a golf ball winding apparatus 22. The basic apparatus is well-known in the industry. A motor 24 drives a wheel 26 about which there is a rubber belt 28, the belt travels around wheel 30 before returning to drive wheel 26. A wheel 32 bears on a golf ball center 34 in contact with the belt 28. As the golf ball center turns, it draws thread 36 through a tensioning system from supply box 38 of thread 36. From the supply box 38, the thread 36 first passes over an idler roll 40 and then to a tension wheel 42. The tension wheel 42 preferably has a groove (not shown) in which the thread travels. The groove is of less depth than the thickness of the thread so that tension apparatus 44 can apply nip-like pressure on the thread. Tension apparatus 44 comprises a rubber tension wheel 46 and a metal tension wheel 48. Metal wheel 48 is biased for up and down movement. When it is up, no tension is applied to the thread. During normal winding operations, metal wheel 48 is in the down position and causes rubber wheel 46 to engage the thread. The rubber wheel 46 in combination with wheel 42 essentially acts like a nip roll with respect to the thread 36.

From this initial tension apparatus 44, the thread 36 travels around idler roll 50 to a low tension wheel 52. Low tension wheel 52 has tension wheels 46 and 48 which are the same as in tensioning apparatus 44. In this case, however, the tension wheels 46 and 48 bear against axle 54 of low tension wheel 52. It will be appreciated that the pressure which is applied to axle 54 by tension wheels 46 and 48, measured in terms of mass (i.e., 500 g of tension) will directly affect the degree of stretch of the elastic thread 36 as it is wound onto the golf ball core 34. Idler roll 50 may also be adjusted so as to alter the tension applied to the thread during winding. While tension will be increased between tension wheel 52 and golf ball core 34, the rate of feed of thread 36 will be the same since that is solely dependent on the rate of feed through tension apparatus 44.

After low tension wheel 52, the thread passes over a high tension wheel 56. In order to be able to exert sufficient force on the axle 58 of high tension wheel 56, there are two pairs of tension rollers 48 and 46. After the thread leaves high tension wheel 56, it goes through idler roll 60 to the golf ball core. Golf ball center 34 is shown with some windings of thread thereabout to form the core. As the size of the golf ball core increases due to the addition of more thread, wheel 32 rises and rod 62 attached thereto also rises. Rod 62 can suitably be the core of a transducer which can serve as an indicator 64 of the then diameter of the golf ball core. A timer 66 is used in conjunction with motor 24.

In accordance with the present invention, low tension wheel 52 is always engaged while motor 24 is in operation. High tension wheel 56 is not operated during the initial period of winding so that only low tension is being applied to the thread initially. At a preselected point, tension is applied to high tension wheel 56. The instance of engagement of high tension wheel 56 can be determined by timer 66 or by indicator 64 or, preferably, by both. Where a timer is used, the time after thread starts winding about the golf ball center 34 is monitored by the time when the motor starts. At a preselected time, the timer generates a signal which puts high tension wheel 56 into operation. Alternatively, or additionally, indicator 64 can be used. Indicator 64 senses the diameter of the golf ball core. As the threads wind about the center 34, the size of the golf ball core increases. When it has reached a preselected diameter for the amount of low tension thread, the indicator generates a signal to put the high tension wheel 56 into operation. It has been found that best results are achieved when both the timer and indicator are used. This is an additional check in determining any malfunction of the winding apparatus. The timer and/or indicator can also be used to indicate when a golf ball core is fully wound.

It is preferred that the thickness of the thread that forms the wound layer is between about 0.01 to 0.06 in, and more preferably between about 0.018 to 0.03 in. The width of the thread is preferably between about 0.04 in to 0.08 in. More preferably, the thread width is between about 0.06 to 0.07 in. The thread of the wound layer is preferably tensioned under a mass of less than about 700 g at idler roll 50 and/or axle 54. More preferably, the thread of the wound layer is preferably tensioned under a mass of less than about 500 g. Most preferably, the thread of the wound layer is preferably tensioned under a mass of between about 400 and 500 g. Thus, the wound layer preferably has a tension of less than about 700 g. More preferably, the wound layer preferably has a tension of less than about 500 g, and most preferably, between about 400 and 500 g. The tension in the wound layer is actually an average tension because tension, in any one portion of the thread, will vary with cross-sectional area of thread, which also varies.

In another embodiment of the present invention, the thread may be wound at an elongation of less than about 800 percent. In a preferred embodiment, the thread is wound at an elongation of between about 500 and 800 percent. One of ordinary skill in the art would be aware that elongation can be measured by comparing the length of a single tensioned thread wound along the diameter of the center to the same thread in an untensioned state.

The center preferably comprises polybutadiene and, in parts by weight based on 100 parts polybutadiene, about 0 to 50 pph of a metal salt diacrylate, dimethacrylate, or monomethacrylate, preferably zinc diacrylate, and about 0.01 to 2 pph peroxide, such as dicumyl peroxide. Commercial sources of polybutadiene include Cariflex® 1220 manufactured by Shell Chemical, Neocis® BR40 manufactured by Enichem Elastomers, and Ubepol® BR150 manufactured by Ube Industries, Ltd. If desired, the polybutadiene can also be mixed with other elastomers known in the art, such as natural rubber, styrene butadiene, and/or polyisoprene in order to further modify the properties of the center. When a mixture of elastomers is used, the amounts of other constituents in the core composition are based on 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium or nickel. Preferably, the metal salt diacrylate is zinc diacrylate. Suitable, commercially available zinc diacrylates includes those from the Sartomer Corporation. A typical golf ball center incorporates about 1 to 50 pph of zinc oxide in a zinc diacrylate-peroxide cure system that crosslinks polybutadiene during the core molding process. The preferred concentration of zinc diacrylate is from about 0 to 50 pph and preferably about 10 to 30 pph. Most preferably, the concentration of zinc diacrylate is from about 25 to 30 pph.

Free radical initiators are used to promote crosslinking of the metal salt diacrylate, dimethacrylate, or monomethacrylate and the polybutadiene. Suitable free radical initiators for use in the invention include, but are not limited to peroxide compounds, such as dicumyl peroxide, 1,1-di (t-butylperoxy) 3,3,5-trimethyl cyclohexane, a-a bis(t-butylperoxy)diisopropylbenzene, 2,5-dimethyl-2,5 di(t-butylperoxy)hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 and 2.5 pph, based upon 100 parts of butadiene, or butadiene mixed with one or more other elastomers. More preferably, the amount of initiator added ranges between about 0.15 and 2 pph and most preferably between about 0.25 and 1.5 pph.

The center compositions of the present invention may also include fillers, added to the elastomeric composition to adjust the density, elastic modulus, mold release, specific gravity, and/or melt flow index of the center. A density adjusting filler may also be used to control the moment of inertia, and thus the initial spin rate of the ball and spin decay. Fillers useful in the golf ball core according to the present invention include, but are not limited to, zinc oxide, barium sulfate, and regrind (recycled core material ground to about 30 mesh particle size). The amount and type of filler utilized is governed by the amount and weight of other ingredients in the composition, since a maximum golf ball weight of 1.620 ounces has been established by the United States Golf Association ("USGA"). Appropriate fillers generally have a specific gravity ranging from about 2.0 to 20.

Antioxidants may also be included in elastomer centers produced according to the present invention. Antioxidants are compounds which prevent the oxidative degradation of the elastomer. Antioxidants useful in the present invention include, but are not limited to, quinoline type antioxidants, amine type antioxidants, and phenolic type antioxidants.

Other ingredients such as accelerators, e.g., tetramethylthiuram, peptizers, processing aids, processing oils, plasticizers, dyes and pigments, as well as other additives well known to the skilled artisan may also be used in centers of the present invention in amounts sufficient to achieve the purpose for which they are typically used.

The solid center of the present invention preferably has a diameter of greater than about 1.3 in. It has been found that employing a solid center having a diameter of greater than about 1.3 in allows the center to provide much of the desired velocity to the golf ball (i.e., it makes a good "engine"). More preferably, the solid center of the present invention has a diameter of greater than about 1.3 in and less than 1.4 in. It has also been determined that a center having a diameter of 1.4 in or greater does not allow a thick enough layer of low-tension windings, which provide the desired "feel" characteristics to the golf ball of the present invention. Most preferably, the solid center of the present invention has a diameter of greater than about 1.35 in and less than 1.4 in. The solid center of the present invention preferably has an Atti compression of between about 60 and 90. Most preferably, the solid center has an Atti compression of between about 70 and 80.

The solid center has a hardness that may be evaluated by measuring the deformation of the center under an initial load of 10 kg and a final load of 130 kg. By subtracting the two measured values, a center deformation measurement may be obtained (deflection at 130 kg−10 kg). Preferably, the deformation of the center, measured at 130 kg−10 kg, is less than 3.5 mm. More preferably, the deformation of the center, measured at 130 kg−10 kg, is no greater than about 3.1 mm.

Referring to FIG. 1, the cover 14 provides the interface between the ball and a club. Properties that are desirable for the cover are good moldability, high abrasion resistance, high tear strength, high resilience, and good mold release, among others. In accordance with the preferred golf balls, the cover has a thickness to generally provide sufficient strength, good performance characteristics, and durability. Preferably, the cover is of a thickness from about 0.03 in to about 0.12 in. More preferably, the cover has a thickness of about 0.04 to 0.09 in and, most preferably, about 0.05 to 0.085 in. The cover preferably has a Shore D hardness of greater than about 60. Most preferably, the cover has a Shore D hardness of between about 63 and 73 Shore D.

The cover can be formed of any material, such as balata, ionomer, metallocene, polyurethane, or a mixture thereof. The cover of the golf ball is generally made of polymeric materials such as ionic copolymers of ethylene and an unsaturated monocarboxylic acid which are available under the trademark Surlyn® of E. I. DuPont de Nemours & Co. of Wilmington, Del., or Iotek® or Escor® from Exxon. These are copolymers or terpolymers of ethylene and methacrylic acid or acrylic acid partially neutralized with zinc, sodium, lithium, magnesium, potassium, calcium, manganese, nickel, and mixtures thereof.

The cover can also be formed from mixtures or blends of zinc, lithium and/or sodium ionic copolymers or terpolymers. For example, Surlyn® resins for use in the cover are ionic copolymers or terpolymers in which sodium, lithium, or zinc salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid. Most preferably, the cover comprises a blend of zinc and sodium ionic copolymers or terpolymers.

The invention can likewise be used in conjunction with covers having homopolymeric and copolymer materials such as: (1) vinyl resins such as those formed by the polymerization of vinyl chloride, or by the copolymerization of vinyl chloride with vinyl acetate, acrylic esters or vinylidene chloride; (2) polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst; (3) polyurethanes such as those prepared from polyols and diisocyanates or polyisocyanates and those disclosed in U. S. Pat. No. 5,334,673; (4) polyureas such as those disclosed in U.S. Pat. No. 5,484,870; (5) polyamides such as poly(hexamethylene adipamide) and others prepared from diamines and dibasic acids, as well as those from amino acids such as poly (caprolactam), and blends of polyamides with Surlyn, polyethylene, ethylene copolymers, ethyl-propylene-non-conjugated diene terpolymer, etc.; (6) acrylic resins and blends of these resins with poly vinyl chloride, elastomers, etc.; (7) thermoplastics such as the urethanes, olefinic thermoplastic rubbers such as blends of polyolefins with ethylene-propylene-non-conjugated diene terpolymer, block copolymers of styrene and butadiene, isoprene or ethylene-butylene rubber, or copoly(ether-amide), such as Pebax® sold by ELF-Atochem; (8) polyphenylene oxide resins, or blends of polyphenylene oxide with high impact polystyrene as sold under the trademark Noryl® by General Electric Co. of Pittsfield, Mass.; (9) thermoplastic polyesters, such as polyethylene terephthalate, polybutylene terephthalate, polyethylene terephthalate/glycol modified and elastomers sold under the trademarks Hytrel® by E. I. DuPont de Nemours & Co. of Wilmington, Del. and Lomod® by General Electric Co. of Pittsfield, Mass.; (10) blends and alloys, including polycarbonate with acrylonitrile butadiene styrene, polybutylene terephthalate, polyethylene terephthalate, styrene maleic anhydride, polyethylene, elastomers, etc. and polyvinyl chloride with acrylonitrile butadiene styrene or ethylene vinyl acetate or other elastomers; and (11) blends of thermoplastic rubbers with polyethylene, propylene, polyacetal, nylon, polyesters, cellulose esters, etc.

Preferably, the cover is comprised of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly (tetrafluoroethylene) and their copolymers including functional comonomers and blends thereof. The cover may further comprise a polyether or polyester thermoplastic urethane, a thermoset polyurethane, an ionomer such as acid-containing ethylene copolymer ionomers, including E/X/Y terpolymers where E is ethylene, X is an acrylate or methacrylate-based softening comonomer present in 0 to 50 weight percent and Y is acrylic or methacrylic acid present in 5 to 35 weight percent.

Most preferably, the cover comprises a blend of about 40 to 60 weight percent of a sodium ionomer and about 60 to 40 weight percent of a zinc ionomer. The cover may be a construction of one or more layers, but is typically either one or two layers. Suitable methods of forming the cover are well known to one of ordinary skill in the art and include, for example, compression molding, injection molding, or casting.

Any size golf ball may be formed according to the invention, although the golf ball preferably meets USGA standards of size and weight. For example, the final golf ball should typically have an outer diameter of greater than about 1.68 in. The core, comprising the center and the at least one wound layer, will typically have an outer diameter from about 1.51 to 1.62 in. Most preferably, the core will have an outer diameter of between about 1.55 and 1.58 in.

The golf ball has a hardness that may be evaluated by measuring the deformation of the center under an initial load of 10 kg and a final load of 130 kg, and subtracting the two values. By subtracting the two measured values, a golf ball deformation measurement may be obtained (deflection at 130 kg−10 kg). A difference obtained by subtracting the deformation amount of the golf ball from the deformation amount of the center is preferably less than 0.4 mm. Most preferably, the difference obtained by subtracting the deformation amount of the golf ball from the deformation amount of the center is no greater than about 0.3 mm.

EXAMPLES

These and other aspects of the present invention may be more fully understood with reference to the following non-limiting examples, which are merely illustrative of the embodiments of the present invention golf ball, and are not to be construed as limiting the invention, the scope of which is defined by the appended claims. The results obtained with golf balls prepared according to the examples are representative of the improved performance characteristics of golf ball thread wound centers according to the present invention.

Example 1

Golf Ball Prepared According to the Present Invention Compared to a Conventional Wound Ball Two golf balls were prepared: a wound ball constructed using conventional technology and a wound ball constructed according to the present invention. The comparative example golf ball was prepared with a solid polybutadiene center comprising a polybutadiene blend, about 9 phr (parts per 100 parts polybutadiene) trimethylpropyl trimethacrylate ("TMPTMA"), about 5 phr zinc oxide, about 4 phr peroxide, about 18 phr regrind, and about 160 phr filler. The comparative example solid center, which has diameter of 1.065 in, is wound with polyisoprene thread having a thickness of 0.024 in and a width of 0.059 in, at 860 g of tension to an outer diameter of 1.56 in. The comparative example core, which comprises the solid center and wound layer, is covered with a cover comprising a blend of sodium and lithium ionomers. The golf ball of the present invention was constructed with a large, solid, polybutadiene center comprising a polybutadiene blend, about 25 phr (parts per 100 parts polybutadiene) zinc diacrylate , about 6 phr zinc oxide, about 0.5 phr peroxide, and about 4 phr filler. The solid center of the present invention, which has a diameter of 1.39 in, is wound with polyisoprene thread having a thickness of 0.024 in and a width of 0.059 in, at 500 g of tension to an outer diameter of 1.56 in. The core of the ball of the present invention, which comprises the solid center and wound layer, is covered with a cover comprising a blend of sodium and zinc ionomers. The resulting golf ball properties of both wound golf balls are presented in tabular form below.

TABLE 1

Conventional Wound Ball v. Wound Ball of Present Invention

| Ball Properties | Comparative Example | Example of the Invention |
|---|---|---|
| Velocity (ft/s) | 251.9 | 253.7 |
| Compression | 95 | 91 |
| Weight (oz) | 1.603 | 1.603 |
| Cover Hardness (Shore D) | 72 | 68 |
| Coefficient of Restitution (COR) | 0.796 | 0.813 |
| Spin, Standard Driver (rpm) | 3701 | 3317 |
| Spin, Average Driver (rpm) | 4722 | 4273 |
| Spin, 8-iron (rpm) | 8698 | 8683 |
| Spin, ½-Wedge (rpm) | 5950 | 5952 |
| Distance, Standard Driver (yd) | 264.5 | 269.0 |
| Distance, Average Driver (yd) | 234.4 | 236.9 |

As shown in Table 1 above, the golf ball prepared according to the present invention exhibited an increase in velocity while concurrently exhibiting an increase in COR and decreases in cover hardness and compression. The golf ball of the invention exhibited a decrease in driver spin for both a standard (157 ft/s at a launch angle of 9.9°), typical of a professional golfer, and average driver (139 ft/s at a launch angle of 10.6°), typical of a recreational golfer, compared to the comparative example golf ball of conventional technology. One of ordinary skill in the art is readily aware that a decrease in driver spin results in increased distance. The golf ball of the invention exhibited a 4.5-yd increase in distance when hit by a standard driver and a 2.5-yd increase when hit with an average driver. Further, the golf ball of the invention unexpectedly and surprisingly exhibited no significant decrease in spin from either an 8-iron or a ½-wedge. Table 1 above clearly demonstrates that the wound ball of the present invention is longer, while having lower compression and cover hardness that provide better "feel."

Example 2

Deformation of a Golf Ball Prepared According to the Present Invention Compared to the Deformation of Conventional Wound Balls Table 2 below sets forth a comparison of deformation data obtained for the wound ball of the present invention and two conventional wound golf balls: the Titleist® DT Wound and the Maxfli® Revolution.

TABLE 2

Conventional Wound Balls v. Wound Ball of Present Invention

| Properties | Example of the Invention | Titleist ® DT Wound | Maxfli ® Revolution[3] |
|---|---|---|---|
| Center Compression | 74 | <5 | <30 |
| Center Deflection[1] (mm) | 3.1 | 8.9 | 4.9 |
| Ball Deflection[1] (mm) | 2.8 | 2.5 | 2.8 |
| Deformation Difference[2] (mm) | 0.3 | 6.4 | 2.1 |

[1]difference between the deflection measured at 130 kg and the deflection measured at 10 kg.
[2]the center deflection (130 kg − 10 kg) − ball deflection (130 kg − 10 kg).
[3]a wound ball having a large, soft center (>1.4 in), a wound layer, and a urethane cover.

It is clear from Table 2 above that the small (<1.1 in), soft center of the Titleist® DT Wound and the large (>1.4 in), soft center of the Maxfli® Revolution, both exhibit a large deformation, whereas the golf ball of the present invention exhibits a comparatively small deformation.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A wound golf ball comprising:

a center, a cover, and at least one wound layer disposed between the center and the cover, wherein the at least one wound layer is formed of a tensioned elastomeric thread having at least one ply, wound about the center with a tension of less than about 700 g, wherein the center has a hardness of about 60 Shore D to about 90 Shore D, wherein the center has a first deformation value, formed by applying a load to the center within the range from an initial load of 10 kg to a final load of 130 kg, wherein the golf ball has a second deformation value, formed by applying a load to the golf ball within the range from an initial load of 10 kg to a final load of 130 kg, and wherein the second deformation value differs from the first deformation value by less than 0.4 mm.

2. The golf ball of claim 1, wherein the second deformation value differs from the first deformation value by about 0.3 mm or less.

3. The golf ball of claim 1, wherein the tension is less than about 500 g.

4. The golf ball of claim 3, wherein the tension is between about 400 g and 500 g.

5. The golf ball of claim 1, wherein the first deformation value, formed by applying a load to the center within the range from an initial load of 10 kg to a final load of 130 kg, is less than 3.5 mm.

6. The golf ball of claim 5, wherein the first deformation value, formed by applying a load to the center within the range from an initial load of 10 kg to a final load of 130 kg, is no greater than about 3.1 mm.

7. The golf ball of claim 1, wherein the cover is a single layer.

8. The golf ball of claim 1, wherein the cover is formed of two or more layers.

9. The golf ball of claim 1, wherein the tensioned elastomeric thread comprises two or more plies.

10. The golf ball of claim 1, wherein the tensioned elastomeric thread comprises cis-polyisoprene.

11. The golf ball of claim 1, wherein the tensioned elastomeric thread comprises a blend of cis-polyisoprene and natural rubber.

12. The golf ball of claim 1, wherein the tensioned elastomeric thread has a thickness of between about 0.01 and 0.06 in.

13. The golf ball of claim 12, wherein the thickness is between about 0.018 and 0.03 in.

14. The golf ball of claim 1, wherein the tensioned elastomeric thread has a width of between about 0.04 and 0.08 in.

15. The golf ball of claim 14, wherein the width is between about 0.06 and 0.07 in.

16. The golf ball of claim 1, wherein the center comprises polybutadiene.

17. The golf ball of claim 16, wherein the center further comprises a metal salt diacrylate, a free radical initiator, and a filler.

18. The golf ball of claim 1, wherein the center has a center diameter of greater than about 1.3 in.

19. The golf ball of claim 18, wherein the center diameter is between about 1.3 and 1.4 in.

20. The golf ball of claim 19, wherein the center diameter is between about 1.35 and 1.4 in.

21. The golf ball of claim 1, wherein the center has a hardness of between about 70 Shore D and 80 Shore D.

22. The golf ball of claim 1, wherein the cover has a thickness from about 0.03 in to about 0.12 in.

23. The golf ball of claim 22, wherein the cover has a thickness of about 0.04 to 0.09 in.

24. The golf ball of claim 23, wherein the cover has a thickness of about 0.05 to 0.085 in.

25. The golf ball of claim 1, wherein the cover has a Shore D hardness of greater than about 60.

26. The golf ball of claim 25, wherein the cover has a Shore D hardness of between about 63 and 73 Shore D.

27. The golf ball of claim 1, wherein the cover comprises a blend of about 40 to 60 weight percent of a sodium ionomer and about 60 to 40 weight percent of a zinc ionomer.

28. The golf ball of claim 1, wherein the golf ball has an outer diameter of greater than about 1.68 in.

29. A wound golf ball comprising:

a center, a cover, and at least one wound layer disposed between the center and the cover, wherein the center and the at least one wound layer form a core having an outer diameter of about between about 1.55 inches to about 1.58 inches, wherein the at least one wound layer is formed of a tensioned elastomeric thread having at least one ply, wound about the center with a tension of less than about 700 g, wherein the center has a first deformation value, formed by applying a load to the center within the range from an initial load of 10 kg to a final load of 130 kg, wherein the golf ball has a second deformation value, formed by applying a load to the golf ball within the range from an initial load of 10 kg to a final load of 130 kg, and wherein the second deformation value differs from the first deformation value by less than 0.4 mm.

30. The golf ball of claim 29, wherein the the second deformation value differs from the first deformation value by about 0.3 mm or less.

31. A wound golf ball comprising:

a center, a cover, and at least one wound layer disposed between the center and the cover, wherein the at least one wound layer is formed of a tensioned elastomeric thread of at least one ply having an elongation of less than about 800 percent, and wherein the center has a hardness of about 60 Shore D to about 90 Shore D.

32. The golf ball of claim 31, wherein the center has a first deformation value, formed by applying a load to the center within the range from an initial load of 10 kg to a final load of 130 kg, wherein the golf ball has a second deformation value, formed by applying a load to the golf ball within the range from an initial load of 10 kg to a final load of 130 kg, and wherein the second deformation value differs from the first deformation value by less than 0.4 mm.

33. The golf ball of claim 31, wherein the second deformation value differs from the first deformation value by about 0.3 mm or less.

34. The golf ball of claim 31, wherein the elongation is between about 500 and 800 percent.

35. The golf ball of claim 31, wherein the first deformation value, formed by applying a load to the center within the range from an initial load of 10 kg to a final load of 130 kg, is less than 3.5 mm.

36. The golf ball of claim 35, wherein the first deformation value, formed by applying a load to the center within the range from an initial load of 10 kg to a final load of 130 kg, is no greater than about 3.1 mm.

37. The golf ball of claim 31, wherein the tensioned elastomeric thread has a thickness of between about 0.01 and 0.06 in.

38. The golf ball of claim 37, wherein the thickness is between about 0.018 and 0.03 in.

39. The golf ball of claim 31, wherein the tensioned elastomeric thread has a width of between about 0.04 and 0.08 in.

40. The golf ball of claim 39, wherein the width is between about 0.06 and 0.07 in.

41. The golf ball of claim 31, wherein the center has a center diameter of greater than about 1.3 in.

42. The golf ball of claim 41, wherein the center diameter is between about 1.3 and 1.4 in.

43. The golf ball of claim 42, wherein the center diameter is between about 1.35 and 1.4 in.

44. The golf ball of claim 31, wherein the center has a hardness of between about 70 Shore D and 80 Shore D.

45. The golf ball of claim 31, wherein the cover has a Shore D hardness of greater than about 60.

46. The golf ball of claim 45, wherein the cover has a Shore D hardness of between about 63 and 73 Shore D.

47. A wound golf ball comprising:

a center, a cover, and at least one wound layer disposed between the center and the cover, wherein the at least one wound layer is formed of a tensioned elastomeric thread of at least one ply having an elongation of less than about 800 percent, and wherein the center and the at least one wound layer form a core having an outer diameter of between about 1.55 inches and about 1.58 inches.

48. The golf ball of claim 47, wherein the center has a first deformation value, formed by applying a load to the center within the range from an initial load of 10 kg to a final load of 130 kg, wherein the golf ball has a second deformation value, formed by applying a load to the golf ball within the range from an initial load of 10 kg to a final load of 130 kg, and wherein the second deformation value differs from the first deformation value by less than 0.4 mm.

* * * * *